US006250120B1

(12) United States Patent
Osgood et al.

(10) Patent No.: US 6,250,120 B1
(45) Date of Patent: Jun. 26, 2001

(54) APPARATUS FOR ROTATABLY SUPPORTING THE NECK OF A ROLL IN A ROLLING MILL

(75) Inventors: Peter N. Osgood, Upton; Earl S. Winslow, Jr., Grafton; Thomas C. Wojtkowski, Jr., Shrewsbury, all of MA (US)

(73) Assignee: Morgan Construction Company, Worcester, MA (US)

( * ) Notice: Subject to any disclaimer, the term of this patent is extended or adjusted under 35 U.S.C. 154(b) by 0 days.

(21) Appl. No.: 09/604,504

(22) Filed: Jun. 27, 2000

(51) Int. Cl.[7] ..... B21B 45/02
(52) U.S. Cl. ..... 72/43; 72/41
(58) Field of Search ..... 72/41, 43, 237

(56) References Cited

U.S. PATENT DOCUMENTS

| | | | | |
|---|---|---|---|---|
| 3,757,554 | * | 9/1973 | Kida et al. | 72/43 |
| 3,921,514 | | 11/1975 | Biondetti . | |
| 3,948,072 | | 4/1976 | Aramaki . | |
| 4,037,450 | | 7/1977 | Gilvar . | |
| 4,154,080 | | 5/1979 | Suzuki et al. . | |
| 4,488,419 | | 12/1984 | Quambusch et al. . | |
| 4,520,723 | | 6/1985 | Pav et al. . | |
| 4,803,877 | | 2/1989 | Yano . | |
| 5,253,503 | | 10/1993 | Barten et al. . | |
| 5,495,798 | | 3/1996 | Niskanen et al. . | |
| 5,596,898 | | 1/1997 | Drigani et al. . | |
| 5,765,422 | | 6/1998 | Donini et al. . | |
| 5,782,127 | | 7/1998 | Donini et al. . | |
| 5,870,916 | | 2/1999 | Drigani et al. . | |
| 5,885,201 | | 3/1999 | Brown et al. . | |
| 5,979,305 | | 11/1999 | Wadzinski . | |

* cited by examiner

*Primary Examiner*—Rodney A. Butler
(74) *Attorney, Agent, or Firm*—Samuels, Gauthier & Stevens

(57) ABSTRACT

Apparatus for rotatably supporting the neck of a roll in a rolling mill, including a bearing assembly configured and dimensioned to surround the roll neck, a chock containing the bearing assembly, and a support for the chock, with the chock and the support being in contact with each other at an interface having a radius of curvature arranged to accommodate relative movement between the chock and the support in response to bending loads applied to the roll. A lubricant is introduced under pressure at the interface between the chock and the support to thereby reduce frictional resistance to relative movement therebetween.

9 Claims, 1 Drawing Sheet

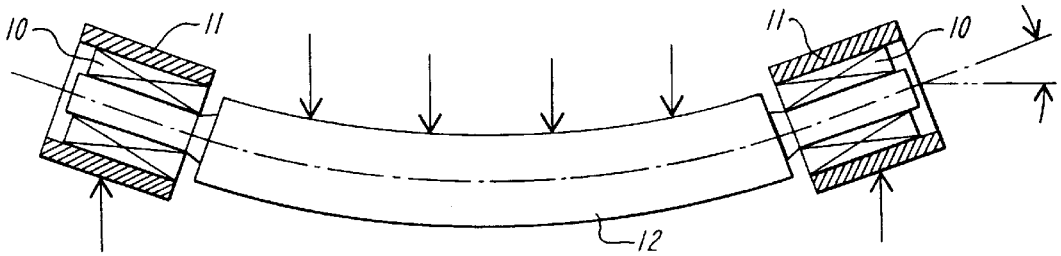
FIG. 1
(PRIOR ART)
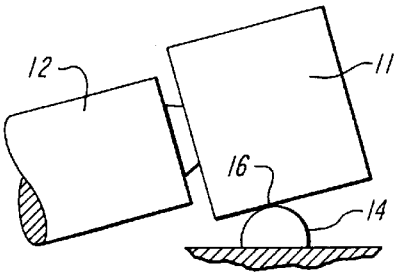
FIG. 2A
(PRIOR ART)
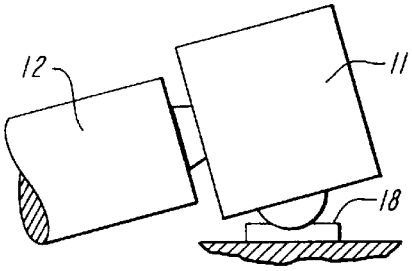
FIG. 2B
(PRIOR ART)
FIG. 3
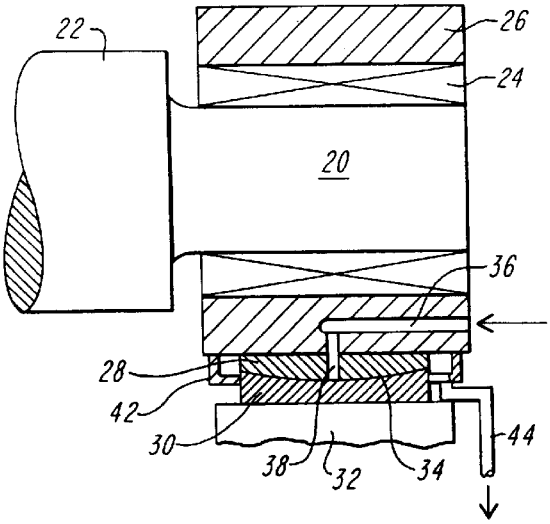
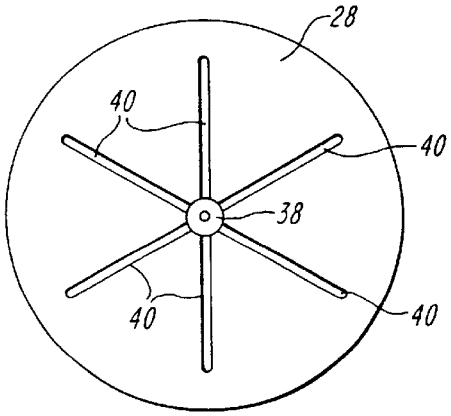
FIG. 4

APPARATUS FOR ROTATABLY SUPPORTING THE NECK OF A ROLL IN A ROLLING MILL

BACKGROUND OF THE INVENTION

1. Field of the Invention

This invention relates generally to rolling mills where the roll necks are rotatably supported in bearings contained in so-called "chocks", and is concerned in particular with an improvement in the manner in which such chocks are supported.

2. Description of the Prior Art

The invention is particularly useful in, although not limited to, "flat" mills, so-called because the products they roll are flat and relatively wide, e.g., plates, strips, and the like. It will be seen from FIG. 1 that the bearings 10 for the rolls 12 in flat mills are long to allow them to carry the large loads typically encountered when rolling flat products. The rolls also are necessarily long to accommodate the width of the products being rolled, and consequently they tend to bend and take on an angle $\alpha$ in the bearing area. To evenly distribute the load over the full lengths of the bearings, the chocks 11 which contain the bearings must be able to tilt to accommodate the angle of the roll neck under load.

In the past, as shown in FIG. 2A, cylindrical rocker plates 14 worked well in allowing the chocks 11 to tilt angularly because of the line contact as at 16. The line contact provided a pivotal location, but did not supply adequate support, so the size of the chocks had to be increased substantially to maintain the required stiffness. Alternatively, as shown in FIG. 2B, spherical seats 18 provided a larger support area which in turn allowed chock sizes to decrease. However, spherical surfaces must slide to allow the chock to tilt. Due to the high rolling loads, the resulting frictional resistance at the larger contact interface acted to prevent the chocks from tilting properly.

SUMMARY OF THE INVENTION

In accordance with the present invention, the chocks and their associated supports are in contact with each other at curved area interfaces arranged to accommodate chock tilting under rolling loads. A lubricant is introduced under pressure at the chock/support interfaces. The area contact at the curved interfaces provides increased support, thereby making it possible to decrease the size of the chocks without sacrificing stiffness. At the same time, the pressurized introduction of the lubricant reduces frictional resistance to chock tilting, thus allowing the system to be fully responsive to rolling loads.

These and other objectives, features and advantages of the present invention will now be described in greater detail with continued reference to the accompanying drawings, wherein:

BRIEF DESCRIPTION OF THE DRAWINGS

FIG. 1 diagrammatically depicts a roll in a flat rolling mill, with roll bending under rolling loads and accompanying chock tilting greatly exaggerated for illustrative purposes;

FIGS. 2A and 2B depict conventional chock supporting arrangements;

FIG. 3 is a cross sectional view through a chock, bearing assembly and support in ccordance with the present invention; and FIG. 4 is a view looking up at the face of the spherical base.

With reference additionally to FIGS. 2 and 3, the neck 20 of a roll 22 is surrounded and rotatably supported by a bearing 24 contained in a chock 26. The bearing 24 is preferably of the oil film type, well known to those skilled in the art, and shown for example in U.S. Pat. No. 4,494,609 (Salter et al.), the description of which is herein incorporated by reference in its entirety. Alternatively, the bearing may be of the rolling element type, again, as well known to those skilled in the art.

The chock 26 is provided with a spherical base 28 seated on a spherical seat 30 forming part of the chock support 32. The base 28 and seat 30 are in contact with each other at a spherical interface 34.

An inlet passageway 36 leads through the chock 26 to a central port 38 in the spherical base 28. Distribution grooves 40 communicate with and radiate outwardly from the port 38 at angularly spaced intervals.

A cover 42 surrounds the interface 34 and communicates with a drain line 44.

In operation, a pressurized lubricant is introduced at the interface 34 via passageway 36, port 38 and distribution grooves 40. The lubricant creates a film on which the base 28 is supported, thus allowing the chock to tilt freely in response to roll bending loads, with inconsequential resistance at the interface 34. Lubricant escaping from the periphery of the interface 34 is captured within the surrounding cover 42 and returned via drain line 44 to the mill lubrication system (not shown) for filtering, cooling and recirculation.

Various changes and modifications may be made to the embodiment herein chosen for purposes of disclosure without departing from the scope of the invention as defmed by the claims appended hereto. By way of example only, and without limitation, the curvature at the interface 34 may be cylindrical or any other mechanically and functionally equivalent configuration capable of accommodating chock tilting while providing adequate area support. The configuration and number of distribution grooves 40 can vary, as can the number and location of ports feeding such grooves. The relative positions of the pad 28 and seat 30 can be reversed.

We claim:

1. Apparatus for rotatably supporting the neck of a roll in a rolling mill, said apparatus comprising:

a bearing assembly configured and dimensioned to surround the roll neck;

a chock containing said bearing assembly;

a support for said chock, said chock and said support being in contact with each other at an interface having a radius of curvature arranged to accommodate relative movement between said chock and said support in response to bending loads applied to said roll; and lubrication means for introducing a lubricant under pressure between said chock and said support at said interface to thereby reduce frictional resistance to said relative movement.

2. The apparatus as claimed in claim 1 wherein said interface is spherical.

3. The apparatus as claimed in claim 1 wherein said interface is cylindrical.

4. The apparatus as claimed in claim 2 wherein said lubrication means includes an inlet port in one of the surfaces defining said interface.

5. The apparatus as claimed in claim 4 wherein said inlet port is centrally located within said interface.

6. The apparatus as claimed in claim 5 further comprising a plurality of distribution grooves in the said one surface, said distribution grooves being in communication with and radiating outwardly from said inlet port at angularly spaced intervals.

7. The apparatus as claimed in any one of claims 1–6 wherein the said lubricant is introduced as a continuous flow which escapes from said interface at the periphery thereof, and wherein said interface is surrounded by a drain into which said escaping lubricant is received for recovery and recirculation.

8. Apparatus for rotatably supporting the neck of a roll in a rolling mill, said apparatus comprising:

a bearing assembly configured and dimensioned to surround the roll neck;

a chock containing said bearing assembly;

a support for said chock, said chock and said support being in contact with each other at an interface having a radius of curvature arranged to accommodate relative movement between said chock and said support in response to bending loads applied to said roll; and lubrication means for introducing a lubricant under pressure between said chock and said support at said interface to thereby reduce frictional resistance to said relative movement, said lubrication means including an inlet port in one of the surfaces defining said interface, and a plurality of distribution grooves in communication with and radiating outwardly from said inlet port at angularly spaced intervals.

9. Apparatus for rotatably supporting the neck of a roll in a rolling mill, said apparatus comprising:

a bearing assembly configured and dimensioned to surround the roll neck;

a chock containing said bearing assembly;

a support for said chock, said chock and said support being in contact with each other at a spherical interface having a radius of curvature arranged to accommodate relative movement between said chock and said support in response to bending loads applied to said roll; and lubrication means for introducing a lubricant under pressure between said chock and said support at said interface to thereby reduce frictional resistance to said relative movement, said lubrication means including an inlet port in one of the surfaces defining said interface, and a plurality of distribution grooves in communication with and radiating outwardly from said inlet port at angularly spaced intervals.

* * * * *